US006341882B1

(12) United States Patent
Lin

(10) Patent No.: US 6,341,882 B1
(45) Date of Patent: Jan. 29, 2002

(54) LIGHT EMITTING CIRCUIT ASSEMBLY FOR TOY

(76) Inventor: Mo-Hsin Lin, 5th Floor, No. 4, Lane 7, Pao Kao Road, Hsintien, Taipei Hsien (TW)

( * ) Notice: Subject to any disclaimer, the term of this patent is extended or adjusted under 35 U.S.C. 154(b) by 0 days.

(21) Appl. No.: 09/658,590

(22) Filed: Sep. 8, 2000

(51) Int. Cl.[7] ..... B41L 47/02; F21V 23/04

(52) U.S. Cl. ..... 362/394; 362/800; 362/806; 101/405; 101/406

(58) Field of Search ..... 362/394, 800, 362/806, 186, 253, 124, 119, 109, 208; 101/405, 406, 327, 368

(56) References Cited

U.S. PATENT DOCUMENTS 5,738,011 A * 4/1998 Tay ..... 101/368

* cited by examiner

*Primary Examiner*—Sandra O'Shea
*Assistant Examiner*—Bao Truong
(74) *Attorney, Agent, or Firm*—Troxell Law Office PLLC

(57) ABSTRACT

A light emitting circuit assembly includes a battery holder holding a battery set and a light emitting element installed in the battery holder, wherein the light emitting element has a first lead-out leg extended in vertical direction and retained between the negative terminal of the battery set and the battery chamber, and a second lead-out leg extended in horizontal, which is forced into contact with the positive terminal of the battery set when the battery holder is forced upwards relative to the light emitting element to curve the first lead-out leg, or disconnected from the positive terminal of the battery set when the upward pressure is released from the battery holder.

1 Claim, 8 Drawing Sheets

LIGHT EMITTING CIRCUIT ASSEMBLY FOR TOY

BACKGROUND OF THE INVENTION

The present invention relates to a light emitting circuit assembly for toy, and more particularly to such a light emitting circuit assembly which closes/opens the circuit by means of the effect of the resilient material property of the lead-out legs of the light-emitting element.

FIG. 1 illustrates a light emitting circuit assembly used in a toy stamp. As illustrated, a compression spring 6' is mounted in a casing 5' around a stamp holder 4', a cover 3' is covered on the casing 5' and supported on the compression spring 6' to hold a light emitting element 1', a battery set 2' and a button 31'. When pressing the stamp holder 4' on a sheet of paper, the stamp holder 4' is moved relative to the cover 3' to force the button 31' inwards against one lead-out leg 11' of the light emitting element 1', thereby causing the light emitting element 1' to emit light. When the pressure is disappeared, the stamp holder 4' is pushed back to its former position by the compression spring 6', and at the same time the button 31' returns to its former position, and therefore the light emitting element 1' is off. This light emitting circuit assembly is complicated. FIG. 2 shows another structure of light emitting circuit assembly according to the prior art. According to this arrangement, the light emitting element 1' has two lead-out legs respectively disposed in contact with the negative terminal of two battery cells 2', and switching means 7' is provided and controlled to electrically connect the positive terminal of the two battery cells 2'. This design requires much horizontal installation space. FIG. 3 shows still another structure of light emitting assembly according to the prior art. According to this design, a contact element 8' is used and adapted to connect one lead-out leg 11' of the light emitting element 1' to the positive terminal of the battery set 2' through a metal spring 6', and the other lead-out leg 11' of the light emitting element 1' is constantly maintained in contact with the negative terminal of the battery set 2'. This design is complicated.

SUMMARY OF THE INVENTION

It is one object of the present invention to provide a light emitting circuit assembly, which has a simple structure. It is another object of the present invention to provide a light emitting circuit assembly, which is inexpensive to manufacture. According to the present invention, the light emitting circuit assembly comprises a battery holder holding a battery set, and a light-emitting element installed in the battery holder. The light-emitting element has two lead-out legs arranged at right angles. The vertically extended lead-out leg of the light-emitting element is disposed in contact with the negative terminal of the battery set. The horizontally extended lead-out leg of the light-emitting element is spaced from the positive terminal of the battery set. When the battery holder is forced against the light emitting element, the vertically extended lead-out leg is curved, causing the horizontally extended lead-out leg to contact the positive terminal of the battery set, and therefore the light emitting element is turned on to emit light. When the pressure is disappeared, the vertically extended lead-out leg immediately returns to its former shape to move the horizontally extended lead-out leg away from the positive terminal of the battery set, and therefore the light-emitting element is off.

BRIEF DESCRIPTION OF THE DRAWINGS

FIG. 7 is similar to FIG. 6 but showing the circuit of the light emitting circuit assembly closed, the light emitting element turned on.

FIG. 10 is an enlarged view of the second embodiment of the present invention, showing the battery holder pushed upwards relative to the light emitting element, the light emitting element turned on.

DETAILED DESCRIPTION OF THE PREFERRED EMBODIMENT

Figure 1:
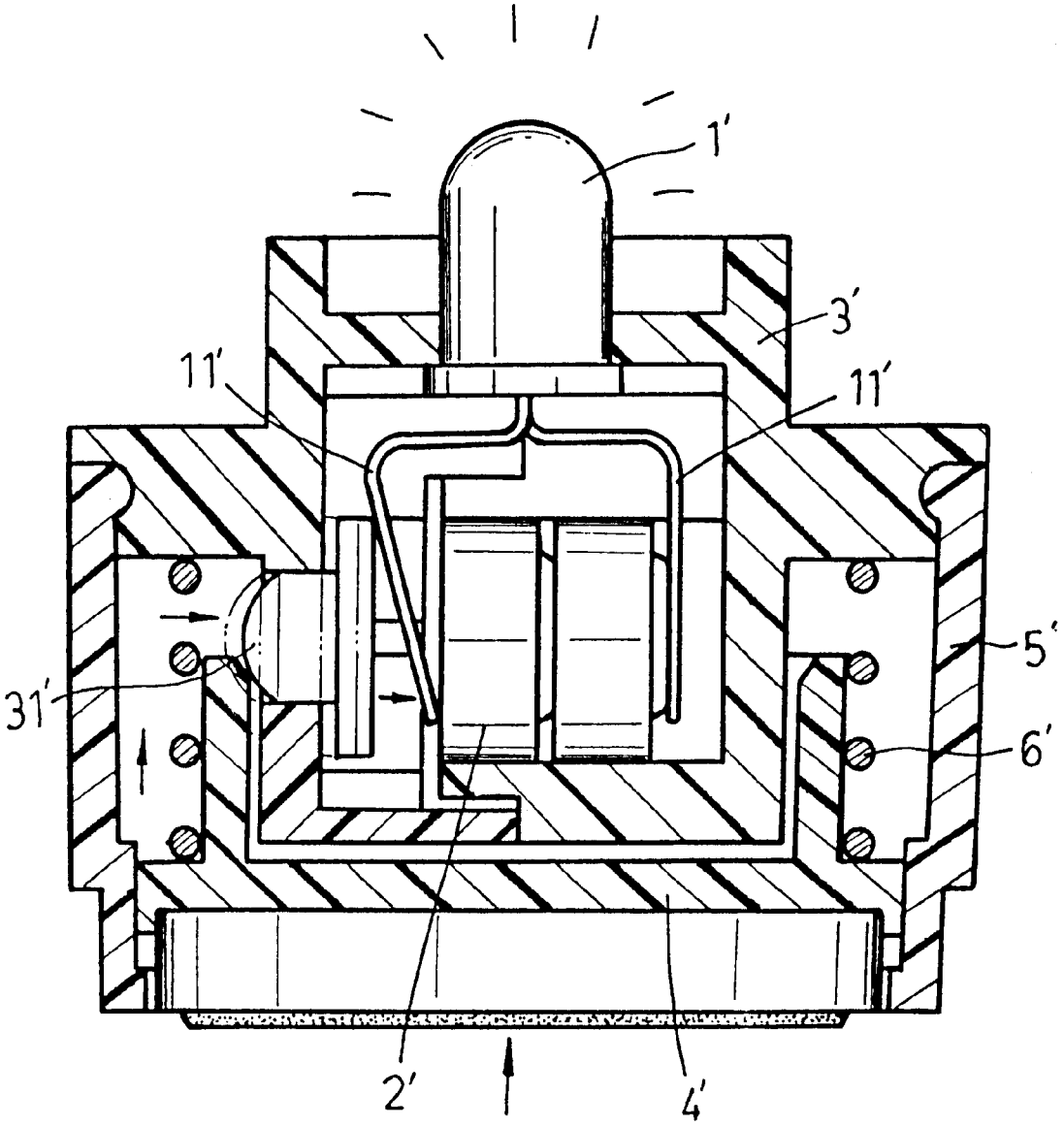
FIG.1 Prior Art
FIG. 1 is a sectional view showing a light emitting circuit assembly used in a toy stamp according to the prior art.
Figure 2:
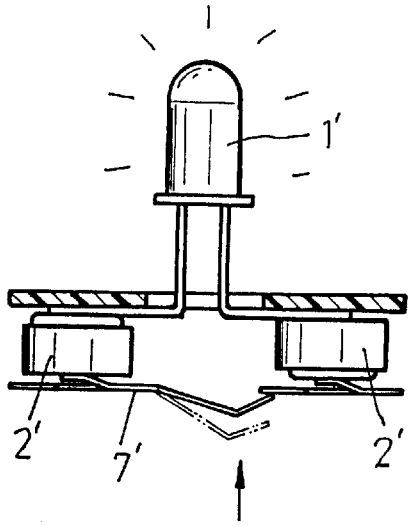
FIG.2 Prior Art
FIG. 2 is a sectional view showing another structure of light emitting circuit assembly according to the prior art.
Figure 3:
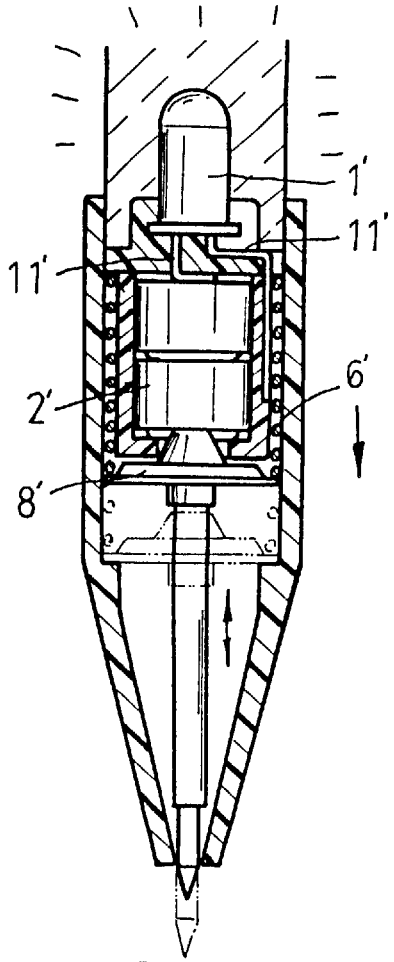
FIG.3 Prior Art
FIG. 3 is a sectional view showing still another structure of light emitting circuit assembly according to the prior art.
Figure 4:
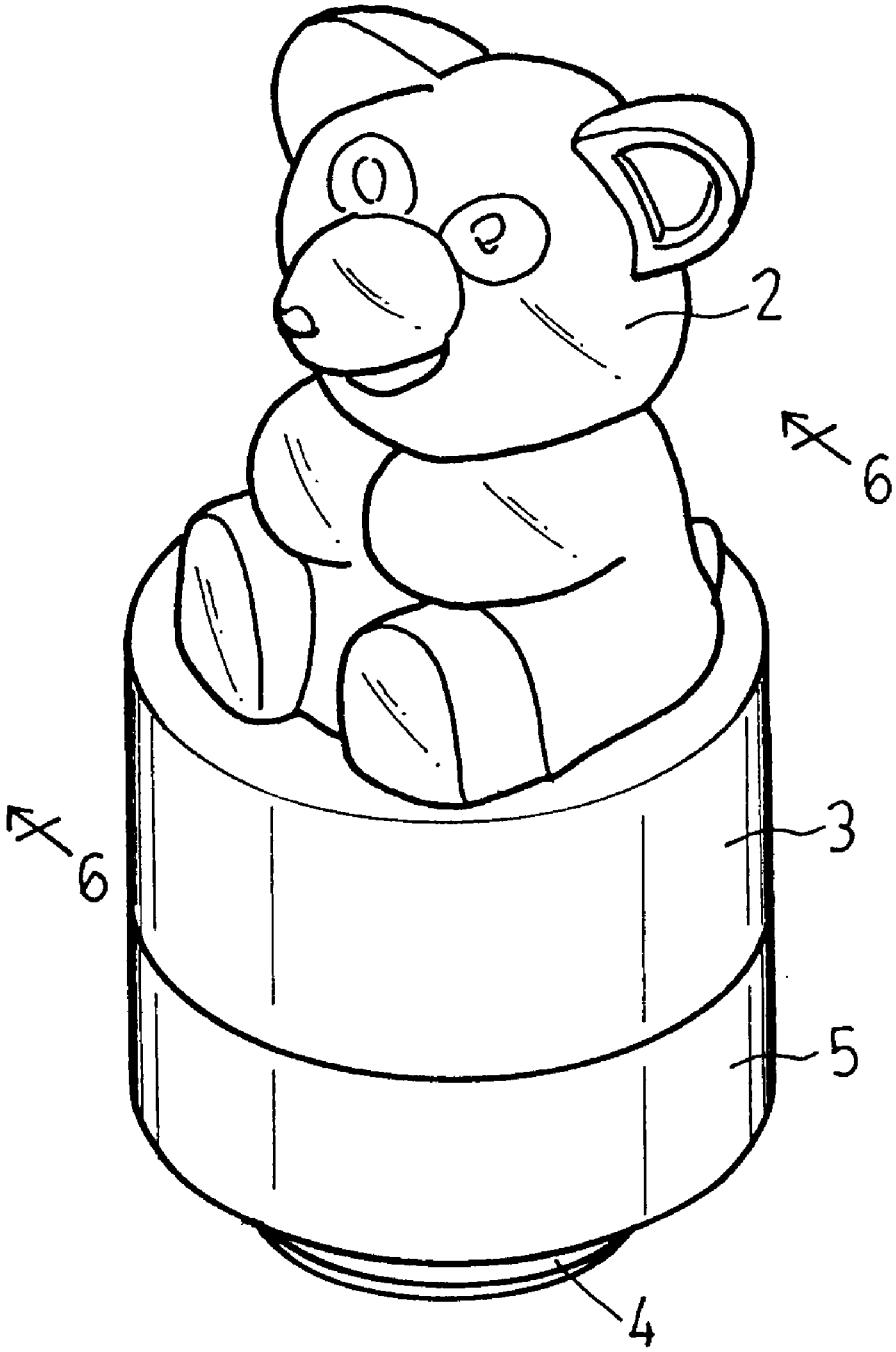
FIG. 4 is a perspective view of a toy stamp constructed according to the present invention.

Referring to FIGS. from 4 through 6, a light emitting circuit assembly 1 is shown comprised of a light emitting element 11, a set battery cells 12, and a battery holder 13. The light-emitting element 11 comprises a base 111, and two lead-out legs 112 and 113 extended out of the base 111. The lead-out legs 112 and 113 are made of resilient metal and arranged at right angles outside the base 11, i.e., one lead-out leg 112 extends out of the base 111 in vertical direction, and the other lead-out leg 113 extends out of the base 11 in horizontal position. The battery holder 13 comprises a battery chamber 131 adapted to receive the battery set 12, and a locating groove 132 vertically extended in the battery chamber 131. The vertically extended lead-out leg 112 of the light emitting element 11 is inserted into the vertically extended locating groove 132 in the battery holder 13 and retained between the peripheral wall of the battery chamber 131 and the negative terminal 121 of the battery set 12, keeping the horizontally extended lead-out leg 113 of the light emitting element 11 in close contact with the positive terminal 122 of the battery set 12.

Figure 5:
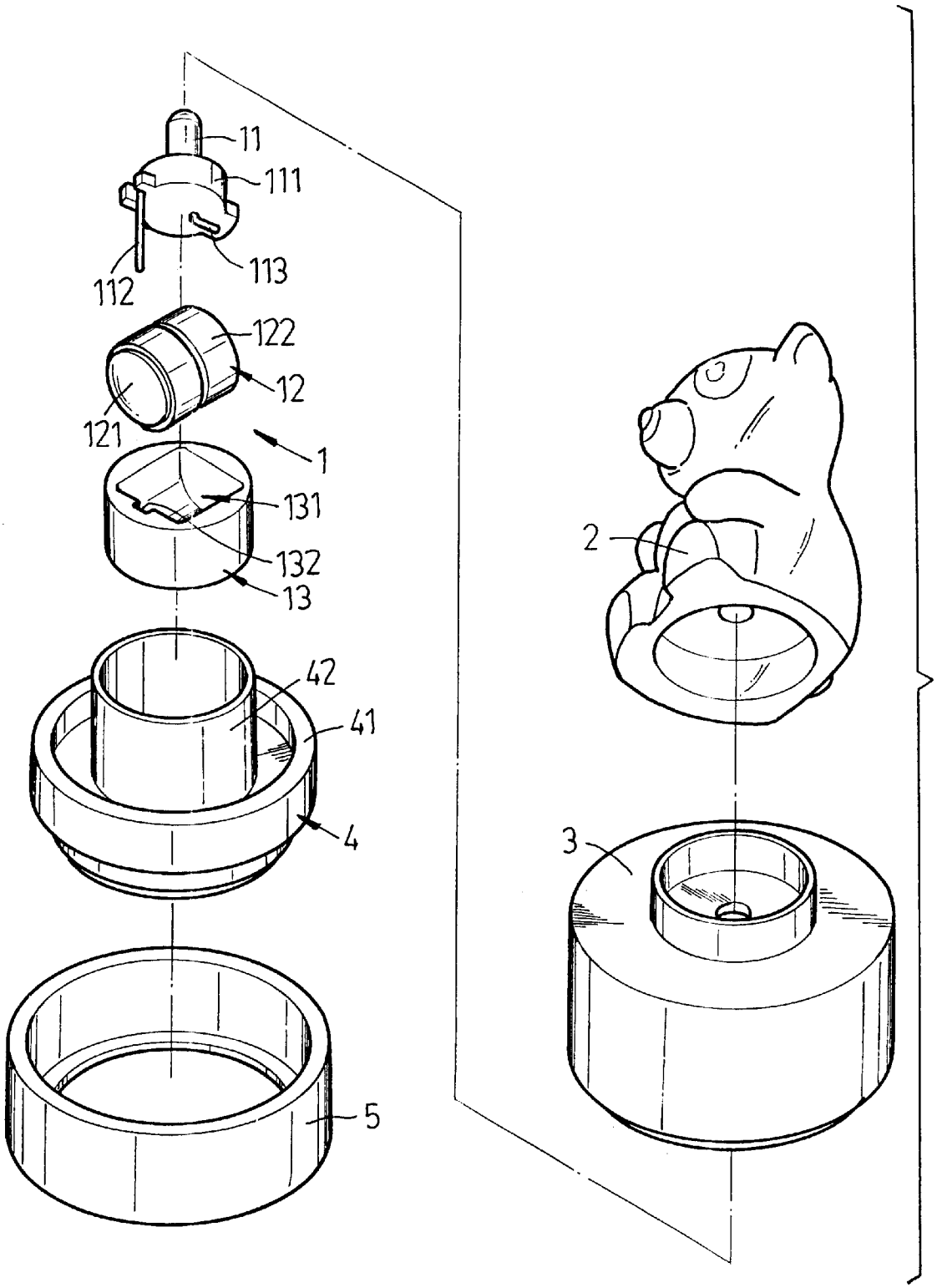
FIG. 5 is an exploded view of the toy stamp shown in FIG. 4.
Figure 6:
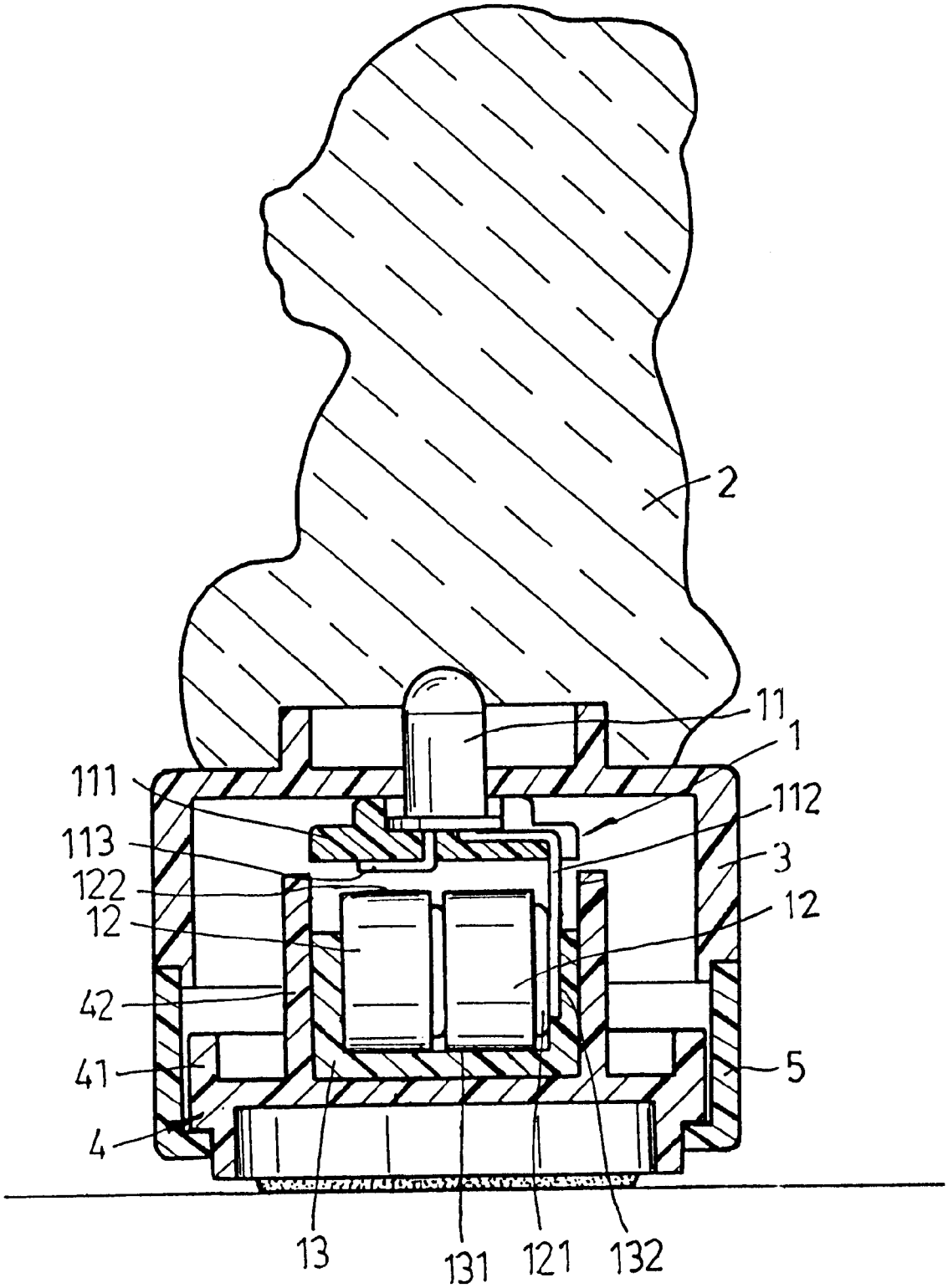
FIG. 6 is a sectional view in an enlarged scale taken along line 6—6 of FIG. 4.
Figure 8:
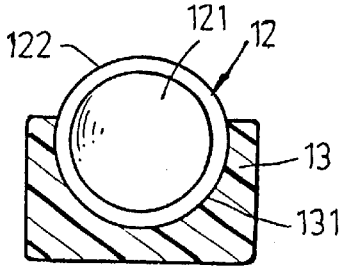
FIG. 8 is a transverse view in section of a part of the present invention, showing the battery set installed in the battery chamber of the battery holder.

Referring to FIGS. 6 and 8 and FIG. 5 again, the two opposite lateral side walls of the battery chamber 131 are respectively curved inwards. When inserting the battery set 12 into the battery chamber 131, the two opposite lateral side walls of the battery chamber 131 are forced outwards for enabling the battery set 12 to be inserted into position. After insertion, the opposite lateral side walls of the battery chamber 131 are forced back to their former positions by their material spring power, and therefore the battery set 12 is positively secured in position. After installation of the battery set 12 and the light emitting element 11 in the battery holder 13, the battery set 12 is pressed on the vertically extended lead-out leg 112 of the light emitting element 11 against the battery holder 13, and therefore the light emitting element 11 is secured to the battery holder 13. (see FIG. 6).

Figure 7:
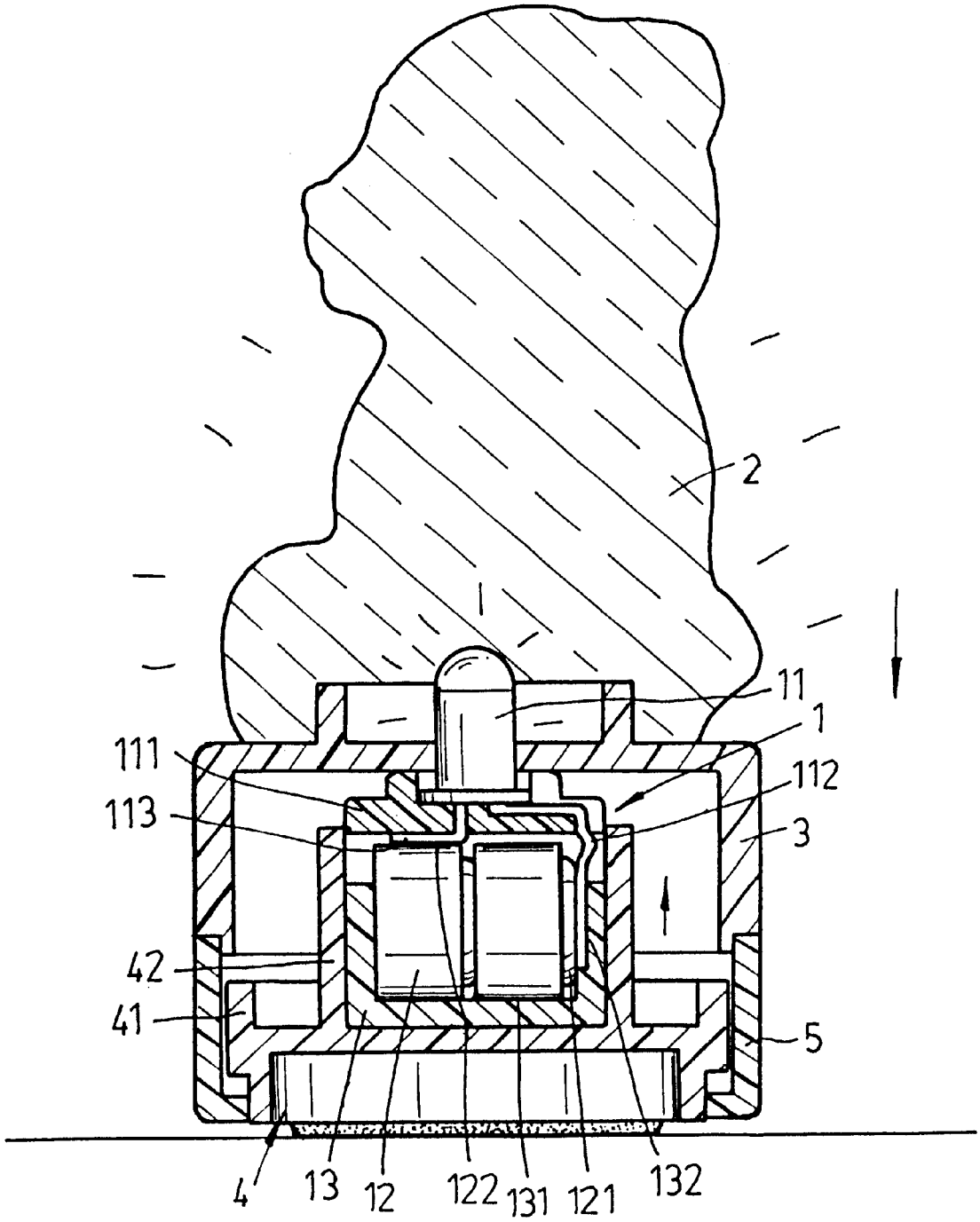

Referring to FIG. 7 and FIG. 5 again, the light emitting circuit assembly 1 is installed in a tubular receptacle 42 in a stamp holder 4. The stamp holder 4 is inserted into a casing 5 and covered with a cover 3. The stamp holder 4 has a stepped peripheral wall 41 fitting the inside wall of the casing 5. The cover 3 holds an ornament 2 that admits light. The light-emitting element 11 is partially suspended in the recessed bottom side of the ornament 2. When stamping the stamp holder 4 (the stamp holder 4 holds a stamp at its bottom side) on a sheet of paper, the vertically extended lead-out let 112 is curved, and the positive terminal 122 of the battery set 12 is forced into contact with the horizontally extended lead-out leg 113 of the light emitting element 11 to close the circuit of the battery set 12 and the light emitting element 11, thereby causing the light emitting element 11 to emit light. After releasing the stamp toy from the sheet of paper, the positive terminal 122 immediately returns to its former shape (due to the effect of its material spring power), and the horizontally extended lead-out leg 113 is moved with the light emitting element 11 upwardly away from the positive terminal 122 of the battery set 12, and therefore the light emitting element 11 is off.

Figure 9:
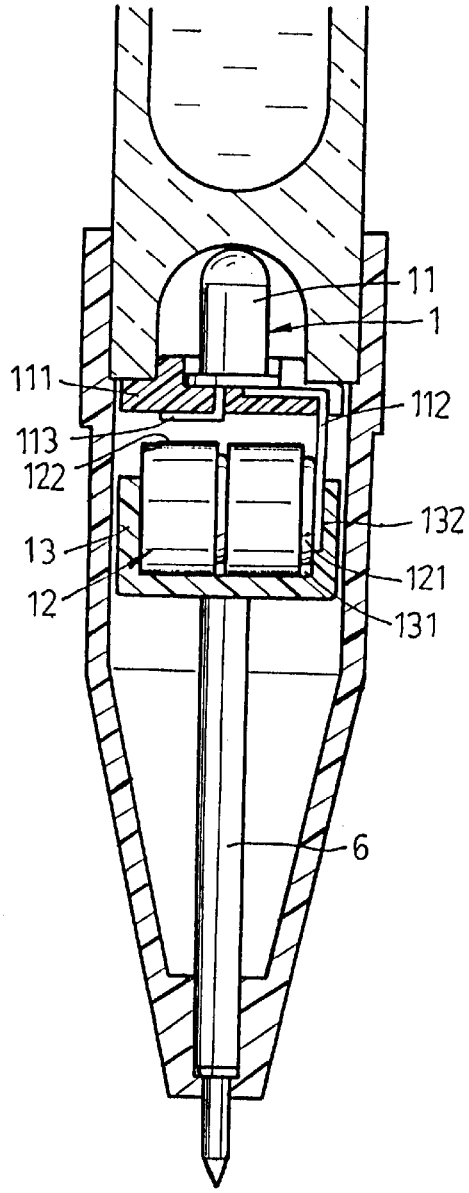
FIG. 9 is a sectional view showing a second embodiment of the present invention.
Figure 10:
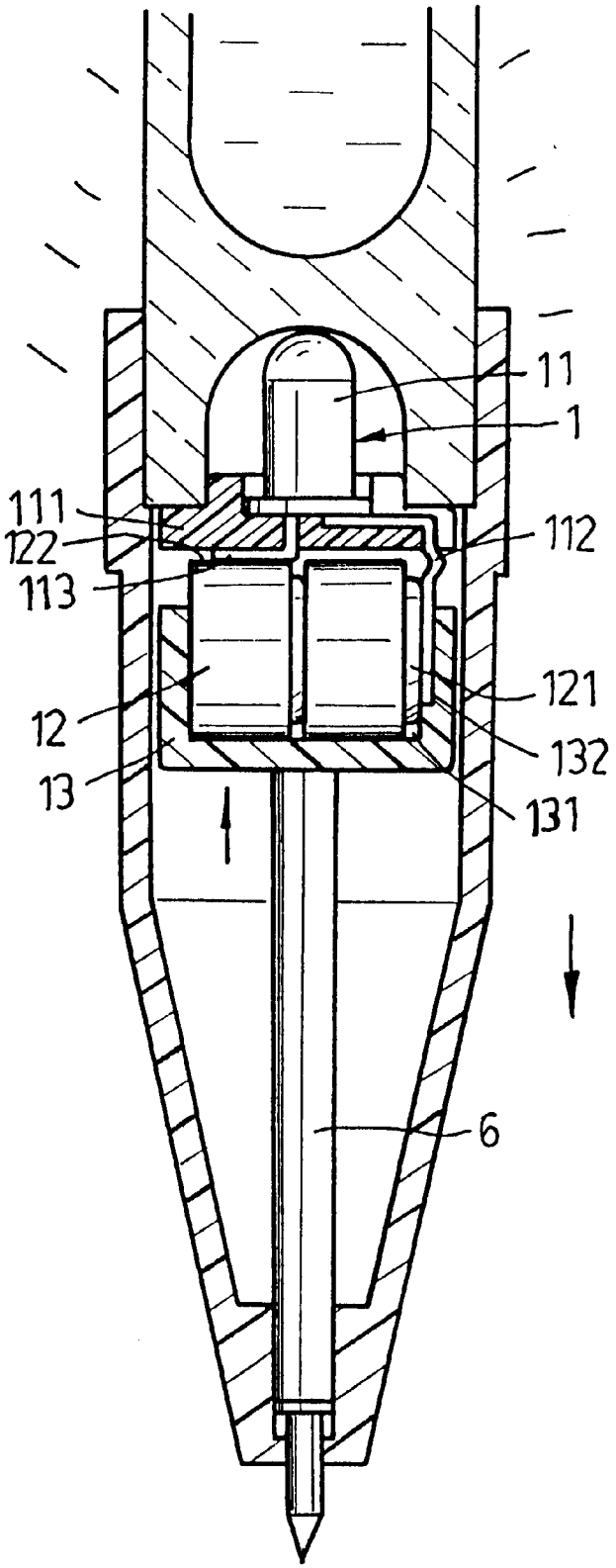

Referring to FIGS. 9 and 10, the light emitting circuit assembly 1 can be used in a writing instrument holding a bubble blower (not shown). When writing, the ink cartridge 6 imparts an upward pressure to the battery holder 13, causing the light-emitting element 11 to emit light. On the contrary, when the upward pressure disappears, the light emitting circuit assembly 1 is off, and the light-emitting element 11 does no work.

It is to be understood that the drawings are designed for purposes of illustration only, and are not intended for use as a definition of the limits and scope of the invention disclosed.

What the invention claimed is:

1. A light emitting circuit assembly comprising:

a) a battery holder having at least one battery with a positive terminal and a negative terminal, the battery holder being movable between first and second positions; and, b) a base having a light-emitting element, the light-emitting element having first and second lead out legs extending therefrom and from the base, at least the first lead out leg comprising a resilient metal and engaging the battery holder so as to contact one of the positive and negative terminals, the second lead out leg located such that it contacts the other of the positive and negative terminals when the battery holder is in the second position, the second lead being out of contact with the other of the positive and negative terminals when the battery holder is in the first position, the resilient metal first lead out providing a sole biasing force on the battery holder urging the battery holder toward the first position.

* * * * *